US008642117B2

(12) United States Patent
Robinson

(10) Patent No.: US 8,642,117 B2
(45) Date of Patent: Feb. 4, 2014

(54) FORMATION OF LAYERS ON SUBSTRATES

(75) Inventor: Martyn Robinson, Cambridge (GB)

(73) Assignee: Conductive Inkjet Technology Limited, Ossett (GB)

( * ) Notice: Subject to any disclaimer, the term of this patent is extended or adjusted under 35 U.S.C. 154(b) by 784 days.

(21) Appl. No.: 11/920,621

(22) PCT Filed: May 16, 2006

(86) PCT No.: PCT/GB2006/001819

§ 371 (c)(1),
(2), (4) Date: Nov. 19, 2007

(87) PCT Pub. No.: WO2006/123144

PCT Pub. Date: Nov. 23, 2006

(65) Prior Publication Data

US 2009/0047423 A1 Feb. 19, 2009

Related U.S. Application Data

(60) Provisional application No. 60/681,950, filed on May 18, 2005.

(30) Foreign Application Priority Data

May 18, 2005 (GB) ..... 0510094.6

(51) Int. Cl.
*B05D 5/12* (2006.01)
*B05D 3/04* (2006.01)

(52) U.S. Cl.
USPC ..... 427/98.4; 427/99.1; 427/99.2; 427/123; 427/301

(58) Field of Classification Search
USPC ..... 427/98.4, 99.1, 99.2, 123, 301; 106/1.05, 1.21
See application file for complete search history.

(56) References Cited

U.S. PATENT DOCUMENTS

| | | | | |
|---|---|---|---|---|
| 3,399,268 | A * | 8/1968 | Schneble, Jr. et al. | 174/259 |
| 5,079,600 | A * | 1/1992 | Schnur et al. | 257/750 |
| 5,685,898 | A | 11/1997 | Dupuis et al. | |
| 6,444,019 | B1 * | 9/2002 | Zou et al. | 106/31.4 |
| 6,461,678 | B1 * | 10/2002 | Chen et al. | 427/304 |
| 2005/0022692 | A1 * | 2/2005 | Eu et al. | 106/1.11 |

FOREIGN PATENT DOCUMENTS

| | | | | |
|---|---|---|---|---|
| JP | 06-017255 | A | 1/1994 | |
| JP | 08-507576 | A | 8/1996 | |
| JP | 2004-238731 | A | 8/2004 | |
| JP | 2004-315718 | A | 11/2004 | |
| WO | WO 92/21790 | | 12/1992 | C23C 18/16 |
| WO | WO 2004/068389 | A2 | 8/2004 | |
| WO | WO 2005/045095 | A2 | 5/2005 | C23C 18/16 |
| WO | WO 2005/056875 | A2 | 6/2005 | C23C 18/16 |

* cited by examiner

*Primary Examiner* — Brian K Talbot
(74) *Attorney, Agent, or Firm* — Morgan, Lewis & Bockius LLP

(57) ABSTRACT

A liquid composition for forming an activator-containing layer on a substrate, for activating a chemical reaction to produce a solid layer on the substrate, comprises activator, surfactant and solvent and/or binder. The liquid composition is deposited on a surface of a substrate, desirably by inkjet printing. The layer is used to activate a chemical reaction to produce a solid layer on the substrate surface, e.g. a layer of conductive metal. The surfactant in the liquid composition has beneficial effects on the behavior of the liquid composition when applied to certain substrates.

19 Claims, 3 Drawing Sheets

FORMATION OF LAYERS ON SUBSTRATES

This is a U.S. National Phase Entry of PCT Application No. PCT/GB2006/001819, filed May 16, 2006, and claims the benefit of U.S. Provisional Application No. 60/681,950 filed May 18, 2005 and GB 0510094.6. filed May 18, 2005.

FIELD OF THE INVENTION

This invention relates to the formation of layers on substrates, and concerns a liquid composition for forming an activator-containing layer on a substrate, and a method of forming a solid layer, e.g. of conductive metal, on a substrate using such an activator-containing layer, e.g. by electroless deposition.

BACKGROUND TO THE INVENTION

WO 2004/068389 discloses, inter alia, a method of forming a conductive metal region on a substrate that involves depositing on the substrate, e.g. by inkjet printing, an activator such as a catalyst or catalyst precursor (e.g. palladium acetate) that activates reaction of a solution of metal ions and a solution of a reducing agent to form a conductive metal region on the substrate. In a typical embodiment an activator ink comprising palladium acetate dissolved in a mixture of diacetone alcohol and methoxy propanol, and also including polyvinyl butyral and potassium hydroxide, is deposited on a substrate by inkjet printing. After drying of the printed activator ink, one or more solutions including copper sulphate and formaldehyde are inkjet printed onto the activator-containing layer for reaction to form a conductive copper layer.

PCT/GB2004/004589 (WO 2005/045095) discloses methods of forming a solid layer, e.g. of conductive metal, on a substrate, involving use of an activator-containing layer on the substrate. The layer includes a first chemical functionality, e.g. a polymer reaction product of one or more curable monomers and/or oligomers, which is at least partially insoluble in a liquid applied to the layer. The layer preferably also includes a second chemical functionality such as polyvinyl pyrrolidone (PVP), which is at least partially soluble in the applied liquid.

PCT/GB2004/005088 (WO 2005/056875) discloses methods of forming a solid layer, e.g. of conductive metal, on a substrate involving the use of an activator-containing layer on the substrate. The activator is applied in a curable composition, e.g. comprising UV-curable acrylates and/or methacrylates.

The methods of WO 2005/045095 and WO 2005/056875 may be used, inter alia, in the selective deposition in patternwise manner of conductive metals by electroless plating. Applications of selective metal deposition include, but are not limited to, electrical circuitry, antennas, conductors used in displays, heater elements, interconnects and decoration. In the majority of such applications it is of great interest to have a high degree of control on the size and form of features which are patterned and on the physical properties of the metals formed e.g. the reproducibility of the resistance of a particular metal feature.

A common problem in the deposition of solid materials via an intermediate liquid phase is the so-called "coffee stain" effect. This phenomenon occurs when solid layers are produced from solutions by allowing solvent or carrier to be driven off. A combination of surface tension and thermal effects causes the solid component of a solution to be segregated to the edges of a drop of the solution as the solvent evaporates and the drop dries. This gives rise to a solid layer which has a characteristic ring of thicker solid surrounding its perimeter. In situations where the final solid material consists of a blend of several solid materials, this thicker perimeter ring will often have a different composition to the more even centre section of the material. Visually, this may manifest as a difference in colour or tone of the solid layer. If the solid layer is utilised for its other physical properties, such as chemical reactivity, electrical or semiconducting properties, then this effect can lead to a substantial variation in performance across an area of deposited material.

In the case of a solution which contains a catalytic component to promote electroless deposition, this coffee stain effect may give rise to an uneven distribution of catalytic material and hence a variation in the rate of electroless deposition. In most cases the catalytic material will be concentrated in the thicker coffee stain region, resulting in a higher plating rate in this area and hence an enhancement in the thickness variation across a deposited feature. In the majority of cases this is undesirable.

SUMMARY OF THE INVENTION

In one aspect the present invention provides a liquid composition for forming an activator-containing layer on a substrate for activating a chemical reaction to produce a solid layer on the substrate, the liquid composition comprising activator, surfactant and solvent and/or binder.

In use, the liquid composition (or ink) is applied to a surface of the substrate by any suitable technique, e.g. by inkjet printing. The layer is then used to activate a chemical reaction to produce a solid layer on the substrate surface, e.g. a layer of conductive metal. Typically this involves contact with one or more further liquids.

Thus in a further aspect, the invention provides a method of forming a solid layer on a substrate, comprising applying to a surface of the substrate a liquid composition in accordance with the invention, comprising activator, surfactant and solvent and/or binder, to produce an activator-containing layer on the substrate; and applying one or more further liquids to the layer for chemical reaction, activated by the activator, to form a solid layer on the substrate.

Surfactants are commonly employed to reduce the surface tension of liquids. The presence of surfactant in the liquid composition affects the behaviour of the liquid composition when applied to certain substrates.

The behaviour of the liquid composition when applied to a substrate will depend on the relative polarities of the liquid composition (particularly as determined by the solvent and/or binder content) and of the substrate surface.

Where the liquid composition is less polar than the substrate surface, the hydrophilic part of the surfactant develops a greater affinity for the substrate surface than for the liquid composition. This can result in the polar moieties of the surfactant reorienting themselves, which effectively makes the substrate surface more hydrophobic and increases the surface tension between the substrate surface and the liquid composition. This will increase the contact angle between the liquid and the substrate surface, with the consequence that "pinning" of the edges of the liquid is reduced and wetting becomes less favourable, removing or reducing the tendency for the liquid to dry with a coffee-stain profile. Narrow, well defined lines of activator-containing layer can be produced on a substrate in this case.

This situation typically arises with a liquid composition including solvent and/or binder of low or no polarity (particularly non-aqueous liquids) and substrate having a polar surface (not necessarily highly polar).

Low polar solvents (e.g. having a surface tension at 25° C. in the range 20 to 50 mN/m) include complex or long chain alcohols, such as diacetone alcohol and methoxy propanol.

Polar substrates include polymeric materials such as acrylics, styrenes, polyesters, polycarbonates, polyamides, polyimides, glasses and ceramics with polar or hydroxyl terminated surfaces. In addition non-polar surfaces may be treated to become polar, e.g. by corona or plasma treatment or by the application of a self-assembled monolayer.

Where the liquid composition is more polar than the substrate surface, opposite effects occur. In this case, the hydrophilic part of the surfactant has greater affinity for the liquid composition than for the substrate surface. The surfactant acts to reduce the surface tension between the liquid composition and the substrate surface, with the result that wetting of the liquid composition is improved. Wider lines of activator-containing layer can be produced on a substrate in this case. This effect means that the liquid composition can be used to achieve good wetting on substrates which would otherwise result in undesirable de-wetting. This situation typically arises, for example, where the liquid composition is highly polar, e.g. a water-based composition, or where the substrate surface is hydrophobic or highly non-polar such as with substrates of high density polyethylene or liquid crystal polymers.

The liquid composition may include a mixture of solvents.

The solvent, if present, is a liquid that functions to dissolve or disperse the activator, and also acts as a solvent for the surfactant accounting for the behaviour described above. In use of the composition, the solvent evaporates and does not form a component of the activator-containing layer.

The binder, if present, similarly functions to dissolve or disperse the activator, and also acts as a solvent for the surfactant. The binder may be a liquid species, or may be present in the liquid composition in dissolved state, in solution in the solvent. In use of the composition, the binder (or a product thereof) is present in the activator-containing layer in solid condition, e.g. after drying to cause solvent evaporation or after chemical reaction to cause solidification, e.g. by polymerisation or cross-linking. In the activator-containing layer, the solid binder (or binder product) acts to aid adhesion of the activator to the substrate.

The liquid composition typically comprises both solvent and binder, but it is possible to use just binder or just solvent.

The binder comprises one or more materials which solidify in use, conveniently by undergoing chemical reaction such as polymerisation and/or cross-linking under appropriate conditions. The binder is conveniently curable, with the chemical reaction occurring in response to appropriate curing conditions. For example, the binder may be curable in response to a stimulus such as electromagnetic radiation in a particular wavelength range (e.g. ultra-violet, blue, microwaves, infrared), electron beams or heat. The binder may instead be curable in response to appropriate chemical conditions, particularly the presence of a chemical curing agent or hardener. As a further possibility the binder may be curable in response to the presence of species such as moisture or air. It is convenient to use an ultra-violet curable composition.

The binder thus preferably comprises one or more monomers and/or oligomers which can polymerise and/or cross-link in use. The binder conveniently comprises one or more UV-curable acrylates and/or methacrylates. In this case the composition may also include one or more UV photo initiators, with suitable initiators being well known to those skilled in the art.

Further details of suitable curable materials are disclosed in WO 2005/056875.

The liquid composition, without surfactant, typically has a surface tension (at 25° C.) below about 45 mN/m.

Examples of suitable surfactants for use in the invention include polyether-modified poly-siloxanes (e.g. BYK-333, a polyether-modified polydimethyl siloxane supplied by BYK Chemie, Germany. BYK-333 is a Trade Mark), and acrylate-modified poly-siloxanes such as polydimethyl siloxane derivatives including Addid 300 from Wacker-Chemie GmbH, Germany (Addid 300 is a Trade Mark).

A mixture of surfactants may be used.

Only a relatively small amount of surfactant is needed in the liquid composition to produce an effect. The surfactant is typically present in an amount of less than 1% by weight, possibly less than 0.5% by weight, e.g. in an amount about 0.3% by weight based on the total weight of the composition.

The activator is present in the liquid composition either in solution or as a dispersion (being dissolved or dispersed in the solvent and/or binder) or as a mixture of these states.

The activator conveniently comprises a catalyst or catalyst precursor, e.g. as disclosed in the prior art documents referred to above. Where the solid layer comprises a layer of conductive metal, the activator is conveniently a salt or complex of a conductive metal, preferably a salt of a transition metal, particularly palladium, platinum or silver. This salt may be inorganic, such as palladium chloride, or organic, for example palladium acetate or palladium propanoate.

The current preferred activator is palladium acetate. Palladium acetate is a precursor of palladium which acts to catalyse metalisation reactions. Palladium acetate may be converted to an active or catalytic form by reduction in situ, e.g. by a subsequently applied reducing agent such as dimethyl amine borane (DMAB) to form palladium metal which can catalyse deposition of metal thereon when appropriate further liquid or liquids are applied.

A mixture of activators may be used.

The activator-containing layer may coat most or all of the entire substrate surface. Alternatively, this layer may be formed on the substrate according to a pattern. This may be achieved in several ways. For example, the liquid composition may be applied, e.g. deposited, according to a pattern, e.g. by printing in the desired pattern, particularly by inkjet printing. Alternatively, the activator-containing layer may be patterned after the liquid composition has been applied, for instance as disclosed in WO 2005/056875.

The liquid composition is preferably applied to the substrate surface by a deposition process, for example a printing process. Preferably the deposition process is a non-contact process that is preferably digital, e.g. inkjet printing. When using inkjet printing, properties of the liquid composition should have properties such as viscosity, surface tension etc. that are suitable for deposition in this way.

Printing processes typically result in production of a layer having a thickness greater than 300 nm and possibly significantly thicker.

The liquid composition preferably includes first and second chemical functionalities, as disclosed in PCT/GB2004/004589.

Other optional and preferred features are as disclosed in WO 2004/068389, WO 2005/045095 and WO 2005/056875.

The activator-containing layer is typically in solid condition, e.g. after drying or curing, before further liquid or liquids are applied. The further liquid(s) may be applied by a variety of techniques including deposition techniques as discussed above and immersion techniques.

The solid layer is conveniently a conductive metal layer, which may be formed by a variety of different processes involving the activator in the activator-containing layer. Suitable processes typically involve the reduction of metal ions, and include the process disclosed in WO 2004/068389 and also electroless plating, e.g. as discussed in WO 2005/045095 and WO 2005/056875.

The method of the invention finds application in formation of solid layers on substrates, particularly in the selective formation of conductive metal layers, in a variety of different contexts and applications, including electrical circuitry, antennas, conductors used in displays, heater elements, interconnects and decorations. The invention includes within its scope an article including a solid layer prepared by the method of the invention.

The invention will be further described, by way of illustration, in the following example, and with reference to the accompanying figures in which.

EXAMPLE 1

Figure 1:
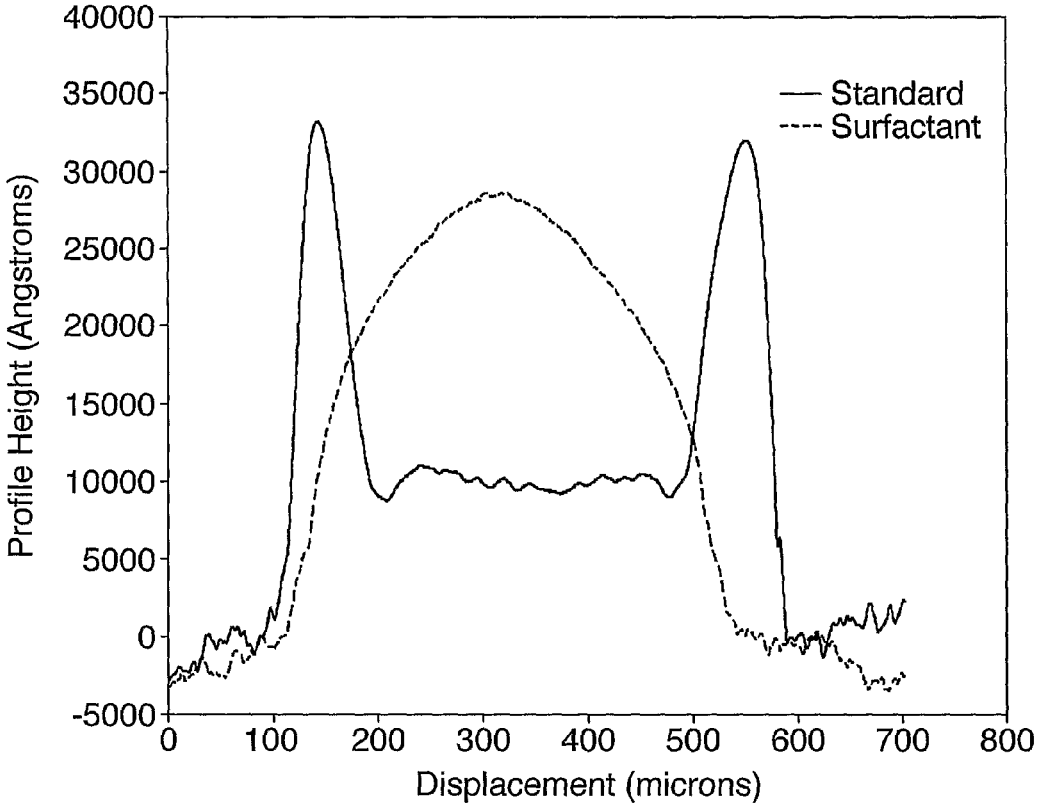
FIG. 1 is a graph of profile height in Angstroms versus displacement in microns of a surface profile plot of cross-sections of three pixel wide lines printed using a standard ink and a surfactant ink in accordance with the invention.

A conventional liquid composition or ink formulation, as disclosed in WO 2005/045095, has the formulation set out in Table 1 below. This will be referred to as a "standard" ink. The ink was prepared by mixing the specified ingredients.

TABLE 1

| Raw material | Qty, % (w/w) | Qty, g |
|---|---|---|
| DPGDA (binder) | 30.5 | 152.5 |
| Actilane 505 (binder) | 10 | 50 |
| DPHA (binder) | 3 | 15 |
| Irgacure 1700 (photo-initiator) | 3.25 | 16.25 |
| Irgacure 819 (photo-initiator) | 1.25 | 6.25 |
| DAA (solvent) | 37.5 | 187.5 |
| 20% solution of PVP K30 in DAA | 12.5 | 62.5 |
| Palladium (II) acetate trimer (activator) | 2 | 10 |

DPGDA is dipropylene glycol diacrylate, supplied by UCB, Dragenbos, Belgium. Actilane 505 (Actilane 505 is a Trade Mark) is a reactive tetrafunctional polyester acrylate oligmer supplied by Akzo Nobel UV Resins, Manchester, UK. DPHA is dipentaerytlritol hexaacrylate, a hexafunctional monomer supplied by UCB, Dragenbos, Belgium. DPGDA, Actilane 505 and DPHA are all UV-curable monomers. Irgacure 1700 and Irgacure 819 (Irgacure is a Trade Mark) are supplied by Ciba Speciality Chemicals, Macclesfield, UK and are both UV photo-initiators. DAA is diacetone alcohol, a slightly polar solvent for the UV curable monomers. PVP K30 is K30 grade polyvinyl pyrollidone from International Speciality Products, which has a molecular weight between 60,000 and 70,000. Palladium (II) acetate trimer, from Johnson Matthey, is a catalyst precursor.

The palladium acetate is initially present in the ink in solution, with a proportion of the palladium acetate potentially being reduced to form a stabilised colloid.

Samples of this standard ink were printed on 100 μm thick Melinex 339 polyester substrate (Melinex is a trademark of Dupont Teijin Films) using a XAAR XJ500/180/UV printhead, printing at a resolution of 180 dpi×250 dpi. This was achieved by running the printhead with a firing frequency of 4 kHz and moving the substrate underneath at a velocity of 0.41 $ms^{-1}$. The ink was then cured using a Light Hammer 6 UV lamp from Fusion Systems, with a 140 mm H bulb giving a radiant intensity of 100 W/cm.

The standard ink formulation was then modified to include 0.3% w/w of the surfactant BYK-333, a polyether-modified polydimethyl siloxane supplied by BYK Chemie, Germany. The full details of this modified formulation are given in Table 2. This will be referred to as a "surfactant" ink.

TABLE 2

| Raw material | Qty, % (w/w) | Qty, g |
|---|---|---|
| DPGDA (binder) | 30.5 | 152.5 |
| Actilane 505 (binder) | 10 | 50 |
| DPHA (binder) | 3 | 15 |
| Irgacure 1700 (photo-initiator) | 3.25 | 16.25 |
| Irgacure 819 (photo-initiator) | 1.25 | 6.25 |
| DAA (solvent) | 37.2 | 186 |
| 20% solution of PVP K30 in DAA | 12.5 | 62.5 |
| Palladium (II) acetate trimer (activator) | 2 | 10 |
| BYK-333 (surfactant) | 0.3 | 1.5 |

This surfactant ink was also printed on Melinex 339 using the same configuration and conditions as the standard ink.

The Melinex 339 substrate is an acrylic coated PET (polyethylene terephthalate), the surface of which is slightly polar. The result of this is that the hydrophilic part of the BYK-333 surfactant develops a greater affinity for the substrate than for the only slightly polar alcohol solvent and acrylate binders in the ink. This effectively makes the substrate more hydrophobic and increases the surface tension between the substrate and the ink. Consequently, "pinning" of the edges of the ink is reduced and wetting becomes less favourable, removing the tendency for the ink to dry with a coffee-stain profile.

FIG. 1 shows surface profile plots of cross-sections of 3 pixel wide lines printed using both inks under the conditions described above. The coffee stain effect can be clearly seen in the standard ink, which gives a fairly even film thickness of around 1 μm but increases to around 3.3 μm at the edges where extra solids are partitioned during curing and drying. In comparison, the surfactant ink gives a more uniform dome-shaped profile which rises to around 2.6 μm at the centre. It should be noted that there is a the difference in scales between the horizontal and vertical axes which exaggerates the profile of the scans.

The surfactant ink also produces a narrower line width than the standard ink, around 434 μm in comparison to 503 μm.

Figure 2:
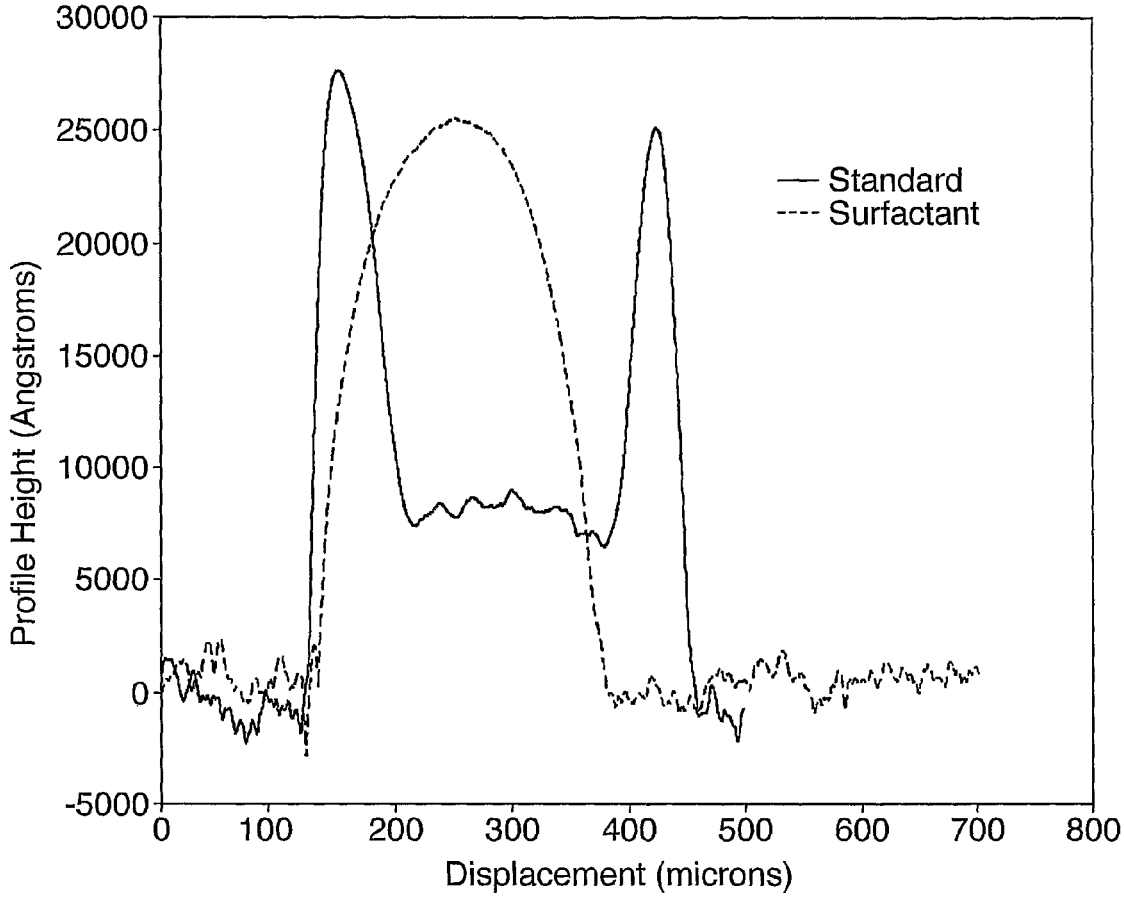
FIG. 2 is a graph similar to FIG. 1, showing results for two pixel wide lines.
Figure 3:
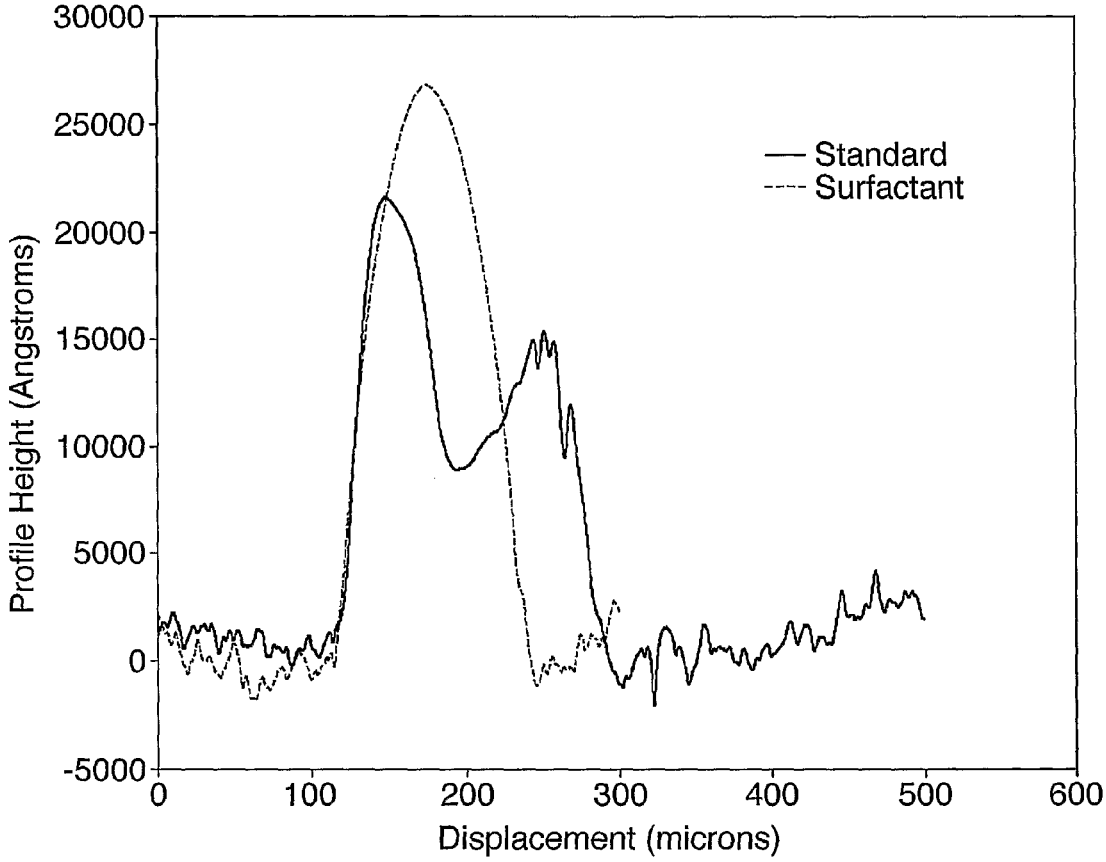
FIG. 3 is a graph similar to FIGS. 1 and 2, showing results for one pixel wide lines.

This effect is more significant in the 2 pixel and single pixel lines shown in FIGS. 2 and 3, respectively. In the 2 pixel lines the surfactant ink gives a 25% narrower line. In the single pixel comparison the surfactant ink lines are around 30% narrower.

Another benefit of the surfactant ink arises from the uniformity of plating. The activator-containing sample layers described above were electroless plated with copper metal by immersing them in a commercial electroless copper plating bath. The bath was made up of Enplate 827 copper plating component solutions A, B and C (Enplate is a Trade Mark, from Cookson Electronic Materials), combined in the ratio 3:3:1 and diluted with 75% w/w deionised water. Enplate 872A contains copper sulphate. Enplate 872B contains a cyanide complexing agent and formaldehyde. Enplate 872C contains sodium hydroxide. The bath was maintained at a temperature of 45° C. As a pre-treatment before plating, the samples were washed in a 1.6% solution of dimethyl amine borane (DMAB) to reduce the palladium acetate to palladium.

After plating for 20 seconds it was noted that the surfactant ink samples formed a continuous copper line. However, the samples produced using the standard ink plated preferentially on the thicker areas at the edges of the lines. At longer plating times this effect evened out and the whole lines became coated in a continuous layer of copper.

It was also noted that lines printed using the surfactant ink produced higher conductivity traces than the equivalent lines printed with the standard ink. Table 3 shows a comparison of the resistance measurements for identical single- and two-pixel line images printed with the two inks.

TABLE 3

| | Standard Ink | Surfactant Ink |
|---|---|---|
| Average Resistance of 1 pixel wide line (ohms) | 162.7 | 103.5 |
| Average Resistance of 2 pixel wide line (ohms) | 105.4 | 81.6 |

The images were of 3 cm long test bars printed and cured on Melinex 339 with a down-web resolution of 500 dpi. The samples were plated for 40 seconds in the electroless plating solution as described above. Average resistance values were taken over 24 samples of each ink. It can be seen that the surfactant ink consistently gives lower resistances than standard formulation.

In comparison, when the surfactant ink is used on hydrophobic substrates e.g. liquid crystalline polymers such as Zenite (Zenite is a Trade Mark) from Dupont, the surfactant acts to reduce the surface tension between the ink and the substrate and as a result the wetting of the ink is improved and line widths become greater than those observed when printing with the standard ink. This effect means that the surfactant ink may be used to achieve good wetting on substrates which usually result in de-wetting when the standard ink is used.

EXAMPLE 2

In order to better quantify the boundary between improved wetting and reduced line widths in different inks, the surfactant BYK333 was added to several different liquids and the contact angle of the liquid with and without the surfactant was examined on Melinex 339 polyester substrate. Since the polar nature of a solvent can be related to its surface tension (with more polar liquids having higher surface tension), the liquids were ranked in order of surface tension as shown in Table 4 below.

TABLE 4

| Name | Surface tension @ 20° C. in mN/m |
|---|---|
| Water | 72.8 |
| Ethylene glycol | 47.7 |
| Polyethylene glycol 300 (PEG) | 43.5 |
| N-methyl-2-pyrrolidone (NMP) | 40.79 |
| Diacetone Alcohol (DAA) | 30.9 |

In all cases 0.3% (w/w) of BYK 333 surfactant was added to a sample of the liquid and drops of the liquid with and without the surfactant were placed on Melinex 339 polyester. In the case of water, ethylene glycol and polyethylene glycol 300, wetting was improved by the addition of the surfactant and the contact angles for the drops with surfactant were noticeably less than those for drops without surfactant. In the case of NMP and DAA the reverse was true, with surfactant loaded liquids showing significantly higher contact angles with the substrate.

From this experiment it may be deduced that addition of the surfactant BYK333 will improve wetting on Melinex 339 for liquids with a surface tension of 43.5 mN/m or higher. Similarly, the addition of this material will cause narrowing of lines for liquids with a surface tension of 40.79 mN/m or lower.

The invention claimed is:

1. A method of forming a solid layer on a substrate, comprising applying to a surface of the substrate a liquid composition comprising an activator, a surfactant, and a solvent and/or binder less polar than the substrate surface, wherein the liquid composition is less polar than the substrate surface, and wherein the surfactant is selected from polyether-modified poly-siloxanes and acrylate-modified poly-siloxanes to produce an activator-containing layer with a cross-section which increases in thickness from the edge of the layer towards the center; and applying one or more further liquids to the activator-containing layer to form a solid layer on the substrate by electroless plating, wherein the solid layer is a conductive metal layer and has a cross-section which increases in thickness from the edge of the solid layer towards the center.

2. A method according to claim 1, wherein the surfactant is present in an amount of less than 1% by weight of the total weight of the composition.

3. A method according to claim 1, wherein the solvent comprises one or more low polar solvents.

4. A method according to claim 3, wherein the solvent is selected from diacetone alcohol and methoxy propanol.

5. A method according to claim 1, wherein the activator comprises a catalyst or catalyst precursor.

6. A method according to claim 1, wherein the activator is a salt or complex of a conductive metal.

7. A method according to claim 1, wherein the activator is palladium acetate.

8. A method according to claim 1, wherein the binder comprises one or more materials that polymerise and/or cross-link to form a solid material.

9. A method according to claim 1, wherein the binder comprises one or more UV-curable acrylates and/or methacrylates.

10. A method according to claim 1, wherein the liquid composition is applied to the substrate surface in patternwise manner.

11. A method according to claim 1, wherein the liquid composition is applied by a deposition process.

12. A method according to claim 11, wherein the deposition process is a non-contact process.

13. A method according to claim 1, wherein the activator-containing layer is formed on the substrate according to a pattern.

14. A method according to claim 11, wherein the deposition process is a printing process.

15. A method according to claim 12, wherein the non-contact process is digital.

16. A method according to claim 15, wherein the digital process is inkjet printing.

17. A method according to claim 1, wherein the solvent and/or binder has a surface tension at 25° C. in the range of 20 to 50 mN/m.

18. A method according to claim 1, wherein the liquid composition is prepared from a precursor composition comprising the activator and the solvent and/or binder without the surfactant, the precursor composition having a surface tension at 25° C. of below about 45 mN/m.

19. A method of forming a solid layer on a substrate, comprising applying to a surface of the substrate a liquid composition comprising an activator that is a salt or complex of a conductive metal, a surfactant, and a solvent and/or binder less polar than the substrate surface, wherein the liquid composition is less polar than the substrate surface and is applied by a deposition process, and wherein the surfactant is selected from polyether-modified poly-siloxanes and acrylate-modified poly-siloxanes to produce an activator-containing layer with a cross-section which increases in thickness from the edge of the layer towards the center; and applying one or more further liquids to the activator-containing layer to form a solid layer on the substrate by electroless plating, wherein the solid layer is a conductive metal layer and has a cross-section which increases in thickness from the edge of the solid layer towards the center.

* * * * *